United States Patent [19]

Travis et al.

[11] Patent Number: 4,977,035

[45] Date of Patent: Dec. 11, 1990

[54] GETTER STRIP

[75] Inventors: Jonathan A. Travis, Oak Ridge; Winfred L. Woodard, III, Midland Park, both of N.J.

[73] Assignee: Ergenics, Inc., Ringwood, N.J.

[21] Appl. No.: 318,609

[22] Filed: Mar. 3, 1989

[51] Int. Cl.[5] ..... B22F 3/10

[52] U.S. Cl. ..... 428/550; 428/553; 428/557; 428/559; 428/562; 428/563; 428/307.7; 252/181.3; 252/181.5; 252/181.6

[58] Field of Search ..... 428/550, 548, 637, 553, 428/557, 559, 562, 563, 307.7; 252/181.3, 181.5, 181.6; 419/8, 43, 69

[56] References Cited

U.S. PATENT DOCUMENTS

| | | | |
|---|---|---|---|
| 3,264,720 | 9/1964 | Mott | 29/185.5 |
| 3,652,317 | 3/1972 | Porta et al. | 117/22 |
| 4,146,497 | 3/1979 | Barosi et al. | 252/181.6 |
| 4,312,669 | 1/1982 | Boffito et al. | 75/177 |

*Primary Examiner*—Stephen J. Lechert, Jr.
*Assistant Examiner*—Ngoclan Mai
*Attorney, Agent, or Firm*—Charles E. Baxley

[57] ABSTRACT

A strip getter structure comprising getter powder pressed into and onto an open reticulated network carrier strip. The getter powder particles form an agglomeration with strength derived both from interlocking of said getter particles and from support of the getter agglomeration by the network. The getter strip structure is manufactured by continuous rolling of getter powder into and onto the network carrier strip by means of a gravity powder feed and a cylindrical rolling mill.

2 Claims, 5 Drawing Sheets

GETTER STRIP

FIELD OF INVENTION

This invention relates to the structure and art of manufacturing a getter in strip form. Getter strip is used widely to remove residual gasses from various vacuum tube or inert gas filled devices, e.g., high intensity electric lamps. The getter operates by strong chemisorption of active gas molecules, such as $H_2$, $O_2$, $H_2O$, CO, $CO_2$, etc., thus removing them from an environment being gettered.

Most practical strip getters consist of active metal powders attached to a surface of an inert carrier strip in such a way as to result in a reasonably high surface area for good gettering rate and capacity. Active powders consist typically of alloys of Zr, Ti, Cr, Ba, Ca, rare earth elements, U or Th, among others, with Zr alloys predominating.

Procedures used for manufacture of most commercial getter strip used today are described in U.S. Pat. Nos. 3,620,645; 3,652,317; 3,856,709 and 3,957,304. These patents describe mechanical pressing techniques whereby relatively hard getter particles are pressed into a softer substrate carrier using an intermediate body that has hardness between the hard getter particles and the soft substrate. In the manufacture of continuous double-sided getter strip, this pressing is accomplished by using a pair of moving rolls which exert forces on a pair of intermediate strips which, in turn, press two layers of getter powder into the surfaces of a single substrate strip. After rolling, the intermediate strips are removed and discarded, leaving the substrate strip with the hard getter particles embedded on both surfaces thereof.

The getter strip product resulting from the above commercially established manufacturing procedure has certain undesirable features. First and foremost, the resultant strip product has only a thin layer of active getter on each surface, typically only a few particle diameters thick, because of the need for physical cold bonding of many particles directly to the substrate. The getter layers is almost two-dimensional in nature. It is advantageous to increase the getter loading unit per length or unit surface area to maximize gettering capacity by producing a more three-dimensional getter structure. Second the foregoing procedure of manufacturing relies on important sequences of relative substrate-getter-intermediate body hardnesses to work. These sequences limit the combination of materials and tempers that can be used and sometimes requires the blending of soft and hard getter powders to achieve higher specific surface areas to increase gettering capacity. Third the relative placement of the getter powder bands, the substrate strip and intermediate body strips must be done with precise control before the composite feed passes through the roll or the product will not be uniform. Fourth the intermediate body strips used in the above mentioned process apparently are used only once and discarded wastefully.

OBJECTS OF THE INVENTION

The present invention eliminates many of the foregoing disadvantages. An improved getter strip is provided which is manufactured by pressing getter powder into openings of a preformed strip provided with an open network resulting in a threedimensional aggregation of pressed getter powder supported by itself and by the network strip.

It is therefore an object of this invention to provide a getter strip that achieves getter loading that is higher than is achievable by cold pressing getter powder into the surface of a monolithic substrate.

It is another object of this invention to provide a getter strip that has greater adherence of the pressed getter powder resulting from bonding and interlocking of getter particles with each other rather than with a soft substrate alone.

It is yet another object of this invention to provide a convenient method of manufacturing getter strip by the direct and vertical rolling of getter powder into and onto a preformed network strip using gravity feed of said powder and a stepped roll.

For a more complete understanding of the foregoing and other features and advantages of the invention, reference should be made to the following detailed description and to the accompanying drawings and examples.

BRIEF DESCRIPTION OF THE DRAWINGS

In the drawings, like reference numerals denote corresponding parts and/or systems throughout the several views.

GENERAL DESCRIPTION OF THE INVENTION

Figure 1:
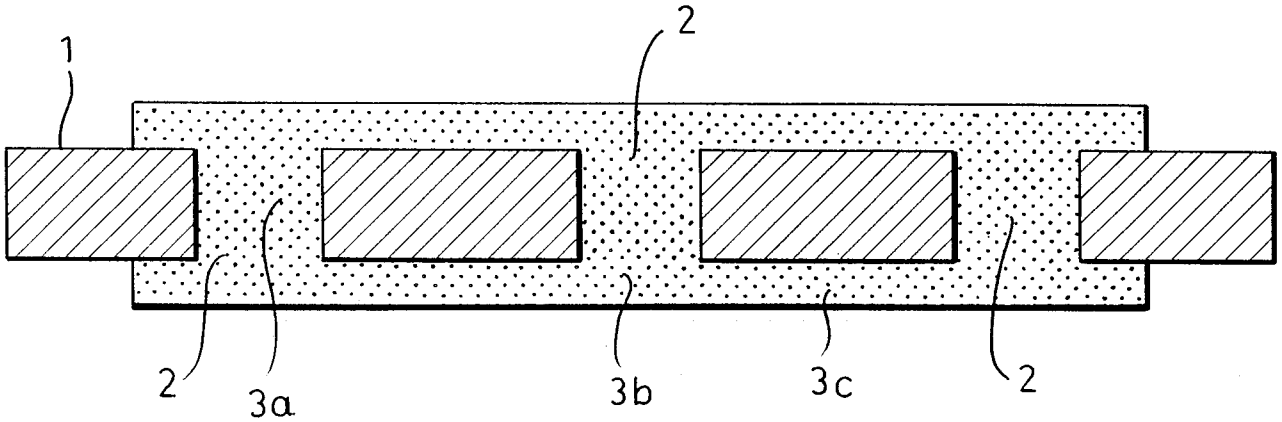
FIG. 1 is a transverse cross-sectional view of a getter strip made by rolling getter powder into and onto a perforated network strip.

A novel feature of this invention is a strip with a substantially three-dimensional distribution of active getter. This strip is achieved by rolling or pressing getter powder into and onto a preformed network strip. The resultant structure is shown in cross-section in FIG. 1. The main requirement is that the network strip 1 has a multitude of holes or openings 2. During manufacture of the getter strip, getter powder 3*a*, 3*b* and 3*c* is pressed forcefully into holes (3*a*) of a network strip, outside the holes (3*b*) and outside (3*c*) of the solid portions of the network strip. The resultant structure is an agglomeration of porous getter powder 3, held together not only by the carrier network 1 but also substantially by mechanical interlocking of the getter particles themselves. Such a getter strip arrangement achieves higher loadings of getter than those conventional strip getters made by pressing getter layers on the surfaces of monolithic (hole-free) substrates. In addition, interlocking of getter particles through holes of the network getter strip results in a structure, in comparison to the conventional surfaced-attached strip, that is much more resistant to spallation of the getter particles during flexing, vibration, handling, etc. In effect, the getter agglomeration is keyed mechanically or attached to the network carrier.

For most practical purposes, the manufacture of getter strip in the structure disclosed herein can be achieved by cold pressing the powder into and on the network strip, in particular by the rolling procedure to be discussed later in these specifications or by the use of progessive dies. Although such an agglomeration has good strength for most purposes, it should be noted that the strength of the getter agglomeration derives mostly from mechanical particle interlocking and the cold pressed structure should not be considered to be completely resistant to fracture and particulation. If it is desired to have greater strength and particulation resistance, it is possible to promote true metallurgical bonding between particles by sintering the cold pressed strip at high temperatures, as those skilled in the art will appreciate. To minimize damage to the getter agglomeration, such sintering should be performed under vacuum or inert gas atmospheres. The sintering times and temperatures depend on the composition and particular sizes of the getter powder to be sintered. Typically, times up to one hour and temperatures in the range of 800°-1300° C. are sufficient for sintering of getter powders.

The preformed open network carrier strip 1 can be of many forms, for example perforated metal strip, expanded metal strip or woven metal screen that has been slit into long strips. Such a network strip can be of any convenient metal that is immune to the environment to be gettered and is metallurgically compatable with the getter alloy to be pressed into and onto it, inherently or during any subsequent sintering treatment used. For example, the network carrier strip can be formed from stainless steel, copper, iron, plated iron, etc. The network strip itself should be reasonably ductile to allow it to elongate slightly during getter powder rolling and allow it to be flexible in the final composite getter strip form. The holes or openings arranged in the network strip to form an open reticulated structure can be formed by punching, etching, drilling, slitting or weaving. Hole shape can be round, oval, square, rectangular, hexagonal or any other convenient shape, although the preferred embodiment is round. The preferred distribution of holes is a hexagonal coordinated array, but rectilinear and other arrays can be used. Generally, the smaller and more numerous the holes, the better is the getter adherence in the final composite agglomeration, but the higher the cost of forming the holes. Preferably, holes range in size from about 0.35 to about 1.0 mm in diameter. The area occupied by the holes preferably varies between about 15 and 60% of the area to be covered by the getter material. Permissible hole packing density decreases with increasing hole size. Hole packing density preferably varies between 150 and 625 per $cm^2$ for the 0.35 mm hole size and between 20 and 80 per $cm^2$ for the 1.0 mm hole size. Preferred carrier strip thicknesses range from about 0.05 to about 0.25 mm. Network strip with high electrical resistivity (e.g., stainless steel) permits getter activation by direct electric resistance heating.

The embodiments of the preformed network strip discussed above constitute a single network layer, as might be represented by a single perforated strip or a screen slit into a single strip. As one skilled in the art will realize readily, network strips can be stacked before getter powder addition, and compaction (to form a multiple layer base) can be used in formation of thicker getter composite strip. Such variants are to be considered within the scope of this invention.

Figure 2:
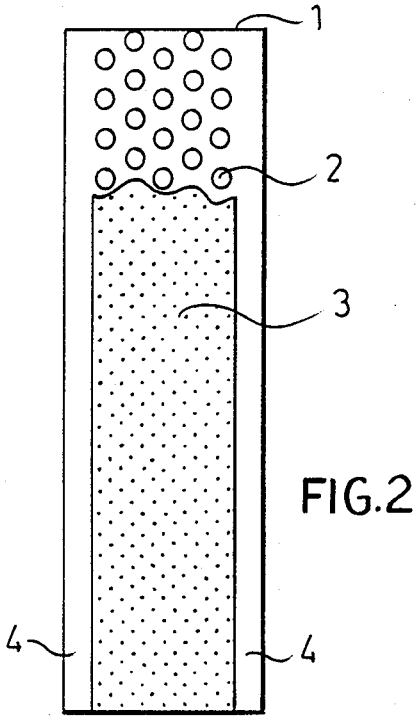
FIG. 2 is a plan view of the getter strip shown in FIG. 1 with part of the getter removed to show how the perforations of the network strip are arranged relative to the getter coverage.
Figure 3:
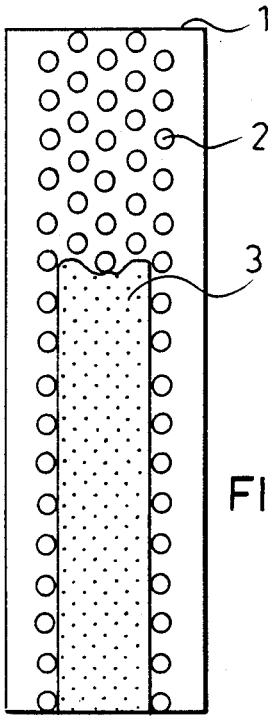
FIG. 3 is a plan view of a getter strip prepared in such a manner that the outer rows of network strip perforations are not filled with getter, for a specific reason.

The most preferred embodiment of network strip is sheet metal perforated with a multitude of holes distributed in a hexagonal array. This array, coupled with a powder rolling technique to be disclosed later herein, allows for useful variations in the resulting getter strip. Examples of two, out of many possible, embodiments of network getter strip products are shown in plan views in FIGS. 2 and 3. For both of these embodiments, some of the getter layer 3 normally present has been shown removed from the network strip 1 to show some of the hexagonally-coordinated perforations contained therein. FIG. 2 shows a strip where all the holes are intended to be filled and covered with getter and small-getter free margins 4 have been left on each side for the user to mount, weld or otherwise attach the strip to structures within the volume to be gettered. FIG. 3 shows a strip wherein two outer rows of holes are left unfilled with getter, so as to serve as sprockets for positive feed of continuous getter strip into and through machines that are used in automatic manufacturing operations.

The preferred method of manufacturing the network getter strip described above is by rolling getter powder directly into and onto an open reticulated network carrier strip. We have successfully reduced this manufacturing method to practice by using the apparatus and method depicted in FIG. 4. The network strip 1 is fed through a slit 5 in bichambered powder hopper 6 that contains getter powder 3. The chambers of the hopper contain carefully sized slits 7 that allow the getter powder 3 to flow by gravity downward at a constant rate and in a stream of well-defined width. The hopper is mounted vertically above a pair of rolls 8. The rolls are turned in the direction shown to compact continuously the getter powder 3 as it flows from slots 7 between the carrier strip 1 and the roll surfaces 8, **8*a*. The size of the slot 7, the roll speed and roll gap are coordinated to create a continuous compaction of the getter powder into the open reticulated network carrier strip and a constant getter loading in terms of mass per unit length or area. The result is an automated, continuous, economical powder rolling process which produces agglomerated getter strip of the structure shown in FIGS. 1 to 3** and comprising important features of this invention.

Figure 5:
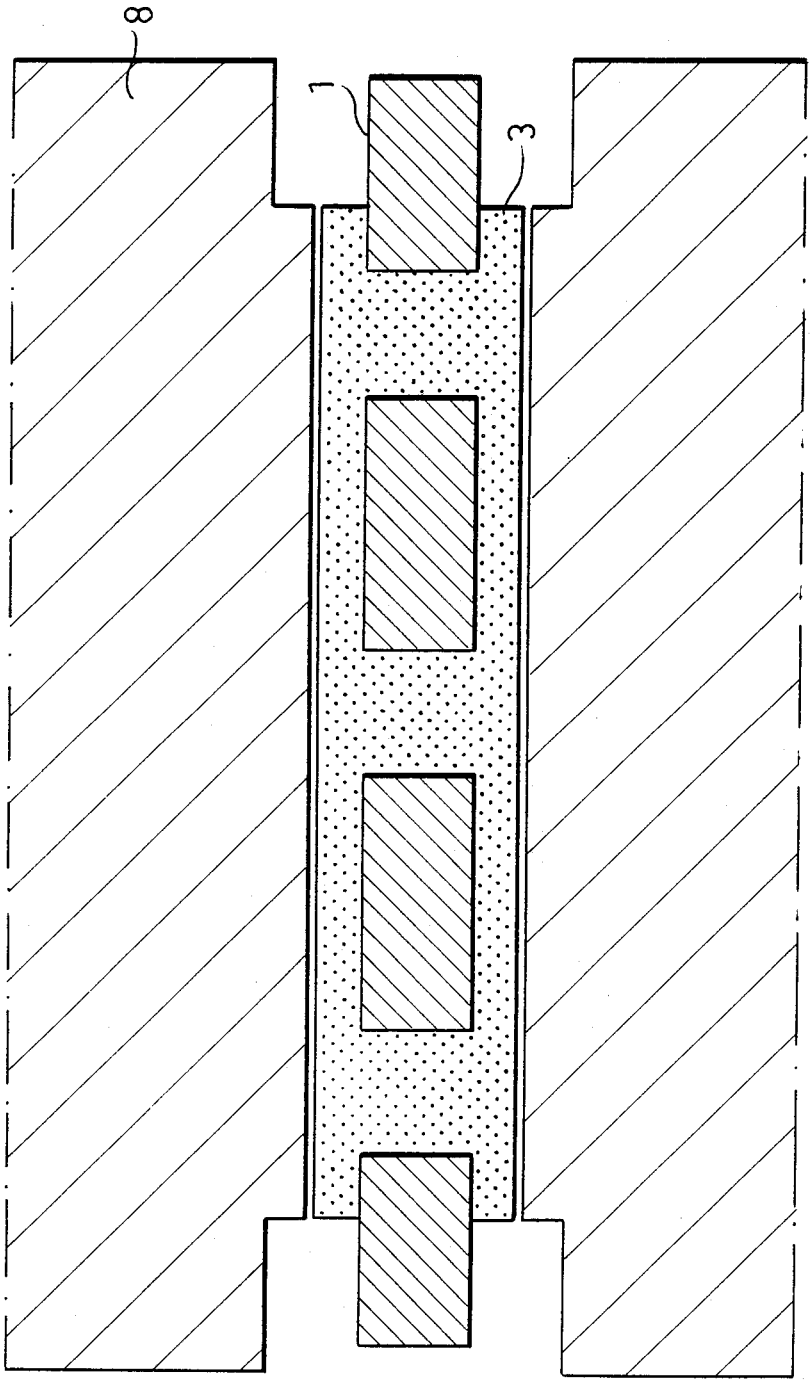
FIG. 5 is a transverse cross-sectional view of a getter strip according to this invention and stepped rolls used to manufacture same.

The rolls 8, **8*a* used for getter powder compaction can be conventional cold rolls used widely in the rolling of metal sheet and strip. To minimize wear the roll surfaces should be considerably harder than the getter powder to be compacted. Surface-hardened steel rolls or rolls coated with hardfacing alloys, titanium nitride, boron nitride, etc., all can be used advantageously. It is very useful to control the width of the compacted band by using a stepped roll as shown in partial transverse cross-section in FIG. 5. Our preferred embodiment employs rolls 8, 8*a* that have small steps or lands 10 that are equal in width to the getter band 3 to be deposited on the reticulated network strip 1**. In operation, only that getter powder that falls between the lands of the two opposing compaction rolls will be compacted into and onto the network strip, thus resulting in a precisely uniform deposit of getter. Powder that falls outside the lands is not compacted and is collected below the rolls for recycling back into the feed hopper.

The invention is amenable to production of agglomerated getter strips from essentially all getter materials that can be prepared in powder form. These materials include, but are not limited to, elements such as Zr, Ti, Cr, Ba, Th, V, Nb, Ta, Ca and rare earth elements, among other possibilities. In addition to elemental getters, it is clearly within the intended scope of this invention to include getter powders or alloys, intermetallic compounds and mixtures of the two, with or without elemental powders also mixed therein. Examples of gettering alloys include, but are not limited to, the commonplace and well-used getter Zr-Al or Zr-V-Fe-Ni-Mn-Al alloys disclosed in U.S. Pat. No. 4,839,085. Examples of gettering intermetallic compounds include, but are not limited to, $BaAl_4$, $ZrMn_2$ and rare earth doped ZrNi and $Zr_2Ni$ disclosed in U.S. Pat. No. 4,668,424. An example of a mixture of alloy and elemental powders, among other possibilities, is Zr-Al alloy mixed with Ti, as disclosed in U.S. Pat. No. 3,926,832. An example of a mixture of intermetallic compound and elemental powders, among other possibilities, consists of $BaAl_4$ mixed with Ni, an evaporable getter composite used widely in the electronic vacuum tube industry.

Using the reticulated network strip concept inherent in this invention, we have produced agglomerated network strips with specific getter loadings of 40 to 70 mg/cm$^2$ of geometric getter surface area. Those skilled in the art will recognize that such getter loadings are significantly higher than getter strips commercially available and-manufactured by rolling on monolithic (nonreticulated) carrier strips and described in U.S. Pat. Nos. 3,620,645; 3,652,317; 3,856,709 and 3,975,304.

The above general description of our invention with preferred embodiments delineated above are hereby shown in reduced form in the following examples:

EXAMPLE 1

Figure 4:
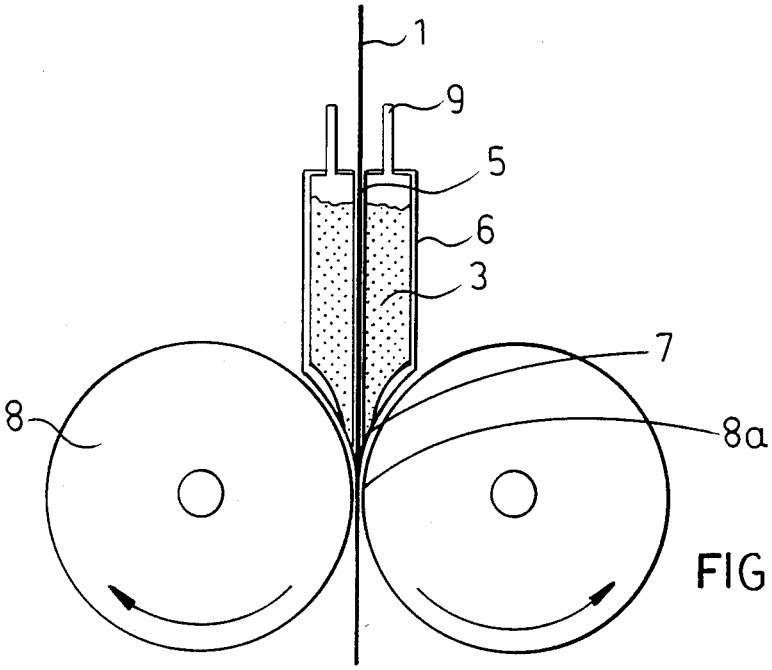
FIG. 4 is a side elevational cross-sectional view of a powder feed and roll setup for manufacturing getter strip according to this invention.
Figure 6:
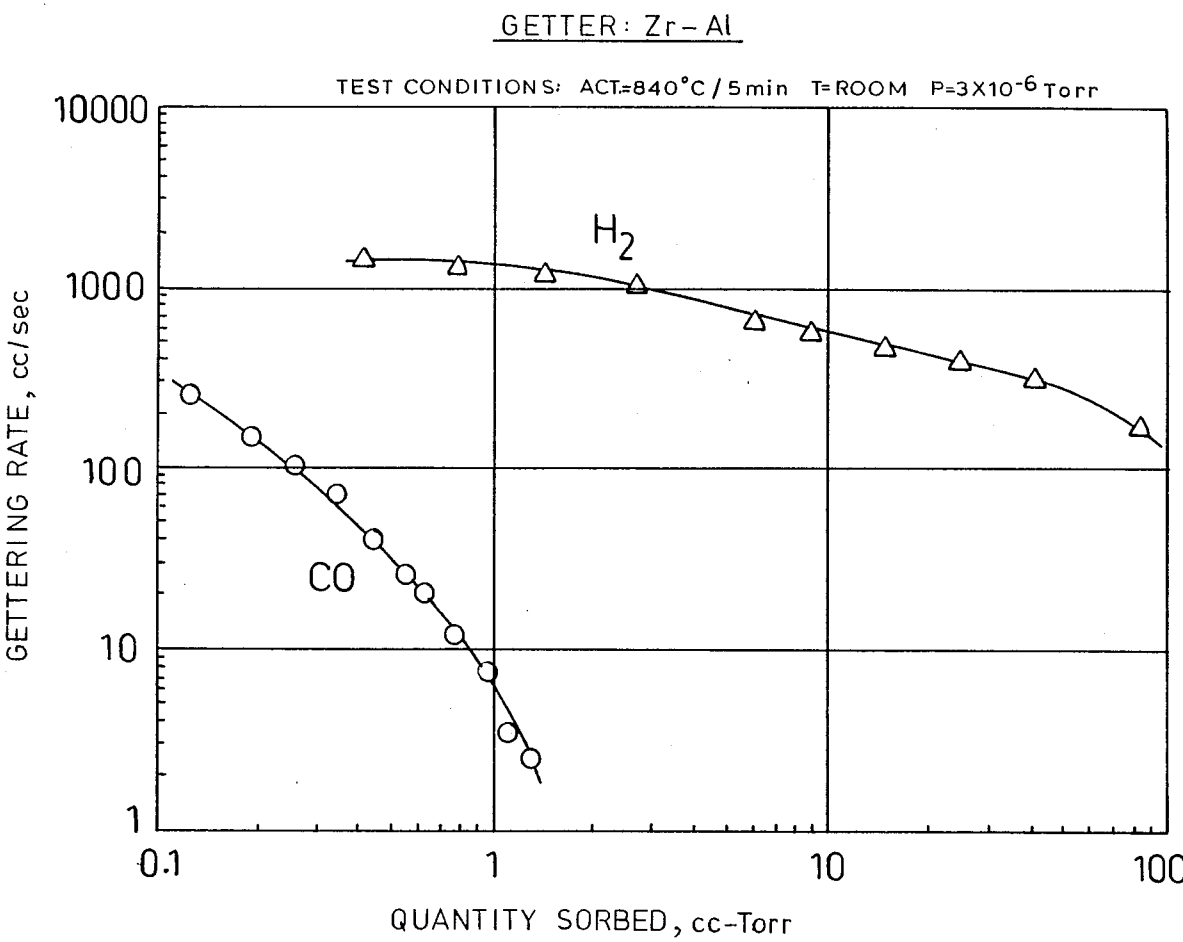
FIG. 6 is a graphical representation of CO and $H_2$ gettering behavior at a pressure of $3\times10^{-6}$ Torr for getter strip made by the teachings of this invention and using getting powder of an alloy of Zr and Al.

A single piece of stainless steel strip 8 mm wide×0.1 mm thick×23 m long was perforated by die punching a multitude of holes along a 5.5 mm wide band for the entire length of the piece to yield an open reticulated network strip. Holes were 0.75 mm diameter and were punched in a hexagonal array to a density of about 66 holes/cm$^2$. This arrangement corresponds to a hole area of 29.1% of the area of the band covered. This strip was carefully cleaned and fed through a powder rolling apparatus, such as shown in FIG. 4, along with getter powder. Getter powder used was prepared by crushing an alloy of 16% Al, by weight, balance Zr and screening same to a particle size range of 230 to 140 mesh (63 to 106 micrometer). Powder flow from the hopper into the rolls was on the order of 0.33 g/s for each of the two hopper sides. The roll surfaces had small lands 5.5 mm wide to control precisely the width of the deposited getter band. Tangential velocity of the rolls at the compaction (land) surface was 5.7 cm/sec. The entire 23 m piece was successfully roll-pressed with getter powder with a single roll pass, resulting in composite getter strip similar to that shown in FIGS. 1, 2 and 5 with a getter loading of about 42 mg/cm of final strip length. The thickness of the finished strip at the getter deposit was about 0.3 mm. The resultant product showed resistance to getter layer flaking and cracking during elastic and limited plastic flexing. The CO and $H_2$ gettering properties were determined using essentially a standard ASTM test technique for nonevaporable getters outlined in ASTM Designation F 798-82. A 1 cm test length was removed from the aforementioned network getter strip and activated by direct resistance heating (19 amps) under vacuum for 5 minutes at 840° C., cooled to room temperature and a pressure of $3\times10^{-6}$ Torr CO applied to generate the gettering "rate vs. content" curve shown in FIG. 6. After completing the CO curve to near-saturation shown in FIG. 6, the same sample was reactivated under vacuum for 5 minutes at 840° C., cooled to room temperature and a corresponding $H_2$ gettering curve determined. The curve also is shown in FIG. 6. Those skilled in the art of gettering will immediately recognize that the data shown in FIG. 6 shows excellent properties for a strip getter, thus showing clearly the basic utility of this invention.

EXAMPLE II

Another powder rolling experiment was performed with all parameters and procedures the same as in Example 1, except for hole size and hole density in the starting perforated carrier strip. In this example, hole diameter was 0.45 mm and density was about 248 holes/cm$^2$. This arrangement corresponds to a hole area of 39.4% of the area of the band covered. After roll bonding, the resultant composite getter strip had a getter loading of 70 mg/cm$^2$, substantially higher than that of Example 1. The product also appeared qualitatively to have a greater degree of particulation and spall resistance than Example 1. This example demonstrates that the getter loading and mechanical properties of the getter strip of this invention can be advantageously varied by variation of the characteristics of the reticulated network carrier strip.

EXAMPLE III

Figure 7:
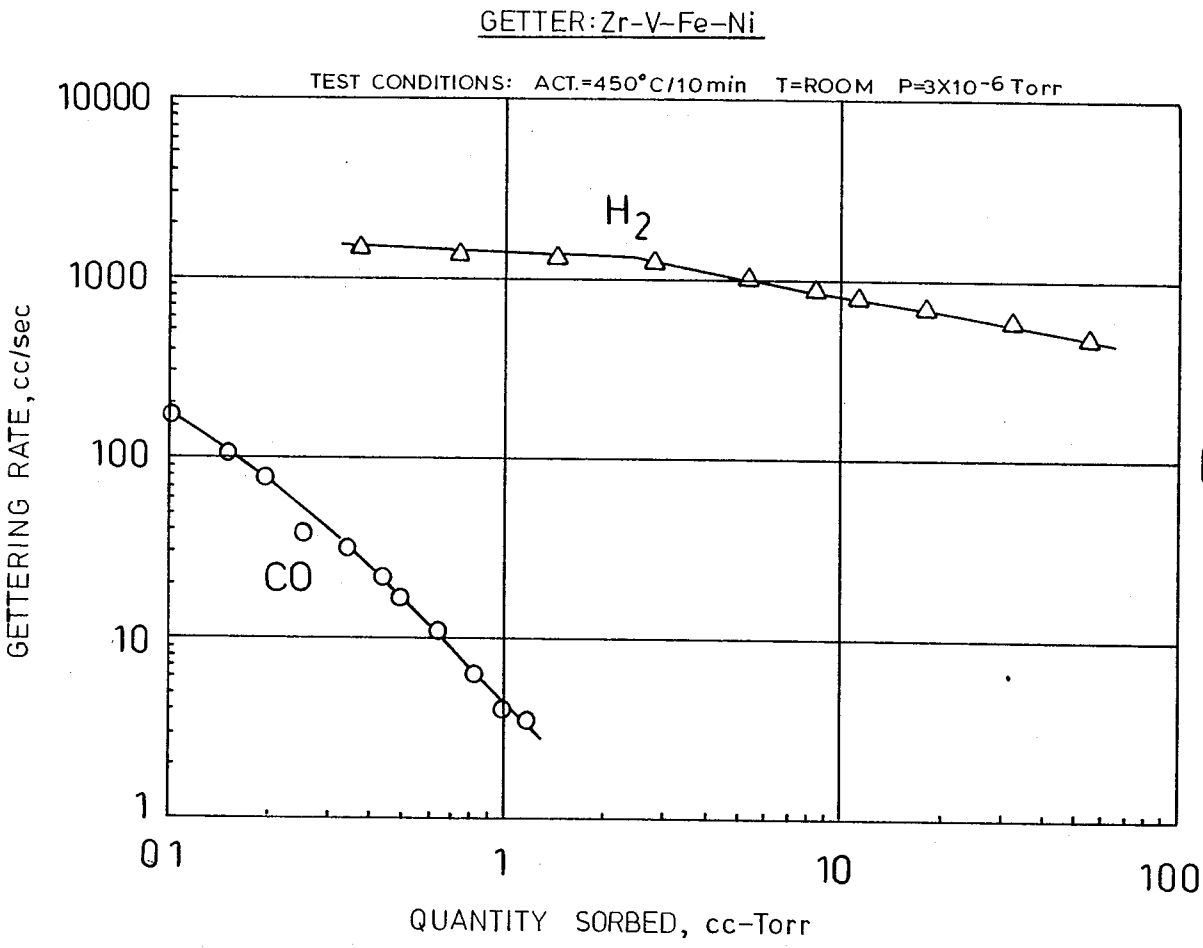
FIG. 7 is a graphical representation of CO and $H_2$ gettering behavior at a pressure of $3\times10^{-6}$ Torr for getter strip made by the teachings of this invention and using getter powder of an alloy of Zr, V, Fe and Ni.

In this powder rolling experiment, perforated network strip and rolling parameters were maintained the same as Example 1. The only differences were getter alloy composition and powder particle size range. Getter alloy used was, by weight percent, 25.5V-3Fe-1.5Ni-balance Zr, a getter composition that requires a relatively low activation temperature and is ground into powder by hydrogen pulverization technique disclosed in U.S. Pat. No. 4,839,085. Powder size range was 230 to 100 mesh (63 to 150 micrometers). After roll bonding, the getter strip had a getter loading of 51 mg/cm$^2$. Getter tests on a 1 cm lengths of this product were performed in an identical manner to Example 1, except that activation conditions were 10 minutes at 450° C. and separate specimens were used for the CO and $H_2$ tests. Results of these tests are shown graphically in FIG. 7. Good gettering behavior will be evident to those skilled in the art, thus demonstrating the utility of this invention when used with a powder of a low activation temperature getter.

It should be understood that the specific forms of the invention herein illustrated and described are intended to be representative only. It is to be understood that certain changes can be made in the invention described above without departing from the clear teachings of the disclosure. Accordingly, reference should be made to the following appended claims which determine the full scope of the invention.

We claim:

1. A composite strip getter structure comprising getter powder pressed into and onto an open reticulated network carrier strip such that the getter powder particles form an agglomeration with strength deriving both from interlocking of said getter particles and from support of the getter agglomeration by the network; the getter powder selected from a group consisting of one or more of Ti, Zr, Cr, V, Nb, Ta, Ba, Th, Ca, Al, Ni, Mn, Fe and one or more rare earth elements; the getter powder composition being a physical mixture of metals in alloyed form and in intermetallic compound form.

2. A composite strip getter structure comprising getter powder pressed into and onto an open reticulated network carrier strip such that the getter powder particles form an agglomeration with strength deriving both from interlocking of said getter particles and from support of the getter agglomeration by the network; the getter powder selected from a group consisting of one or more of Ti, Zr, Cr, V, Nb, Ta, Ba, Th, Ca, Al, Ni, Mn, Fe and one or more rare earth elements; the getter powder composition being a physical mixture of metals in elemental form and in alloyed form and in intermetallic compound form.

* * * * *